United States Patent [19]

Kahler

[11] 4,325,390

[45] Apr. 20, 1982

[54] STABLE FLUIDIC SMOKING DEVICE

[76] Inventor: Richard W. Kahler, P.O. Box 1201, Cape Canaveral, Fla. 32920

[21] Appl. No.: 137,844

[22] Filed: Apr. 7, 1980

Related U.S. Application Data

[63] Continuation-in-part of Ser. No. 699,372, Jun. 24, 1976, abandoned, which is a continuation-in-part of Ser. No. 509,941, Sep. 27, 1974, abandoned.

[51] Int. Cl.[3] ..... A24F 3/00; A24F 3/02

[52] U.S. Cl. ..... 131/173; 220/354

[58] Field of Search ..... 131/173, 214, 222; 220/354

[56] References Cited

U.S. PATENT DOCUMENTS

| | | | |
|---|---|---|---|
| 795,126 | 7/1905 | Hodgson | 220/354 |
| 1,545,220 | 7/1925 | Walker | 131/173 |
| 3,881,499 | 5/1975 | McFadden | 131/173 |

FOREIGN PATENT DOCUMENTS

| | | | |
|---|---|---|---|
| 107388 | 3/1899 | Fed. Rep. of Germany | 131/173 |
| 305802 | 4/1966 | France | 131/173 |

*Primary Examiner*—V. Millin

*Attorney, Agent, or Firm*—Schwartz & Weinrieb

[57] ABSTRACT

A compact, self-supporting fluidic smoking device or utensil comprising a substantially gibbous-like reservoir, the uppermost portion of which extends narrowly upward to form an open neck. A first hollow elongated cylindrical tube having an open upper end is integrally connected to the neck of the reservoir. A second hollow cylindrical tube, having open upper and lower ends is inserted through an aperture defined in the first tube and extends downwardly into the reservoir. The open upper end has a smoking bowl attached thereto for holding tobacco or similar material. The reservoir has a cavity defined in its bottom which opens into the interior of the reservoir so as to facilitate the retention of a liquid material within the reservoir and for facilitating the cleaning of the reservoir.

13 Claims, 3 Drawing Figures

STABLE FLUIDIC SMOKING DEVICE

CROSS-REFERENCE TO RELATED APPLICATIONS

This application is a Continuation-In-Part of my co-pending application Ser. No. 699,372, filed June 24, 1976, now abandoned which, in turn, is a Continuation-In-Part of application Ser. No. 509,941, filed Sept. 27, 1974, now abandoned.

FIELD OF THE INVENTION

This invention relates generally to a device or utensil and more particularly to an improved self-supporting compact fluidic filtered smoking device which is readily adaptable for easy cleaning, improved stability during use, and is particularly useful for the smoking of rare and expensive tobaccos or the like.

BACKGROUND OF THE INVENTION

Smoking devices or utensils utilizing water or other liquid mediums for filtering purposes are well known in the art. These devices are utilized for the smoking of various types of tobaccos by inhaling or otherwise consuming the smoke by drawing the same through a vessel of water or other desirable liquid medium. In general, the smoke is bubbled through the water causing an immediate and effective cooling of the smoke.

In prior art devices or utensils, a bowl of tobacco or the like is disposed so that the smoke may be drawn from the burning tobacco through a conduit submerged in a vessel of water thereby causing the smoke to filter or bubble through the water. The water-cooled smoke is then collected in an upper region above the water line of the vessel and drawn therefrom by the user, preferably through a mouthpiece. A smoking suction applied to the mouthpiece causes the smoke and air to be drawn through the cooling water and eventually into the mouth of the smoker.

A significant problem associated with prior art smoking devices and utensils is their lack of adaptability for cleaning purposes. For example, prior art smoking devices and utensils are generally constructed in such a manner that they do not permit the easy disassemblage of parts for the cleaning of the device since they contain various screws, valves, water-tight seals, in addition to the tubing materials. Moreover, many prior art smoking devices and utensils utilize a canvas bag for holding the water. Because the canvas bags have a rather short service life due to the gradual weathering of the fabric per se and the inability to satisfactorily clean the same after repeated use of the device or utensil, it is therefore necessary to discard the smoking device or utensil after an extended period of use. A need therefore exists for a smoking device or utensil that can be readily assembled and disassembled for cleaning purposes and constructed of materials that need not be discarded after extended usage.

OBJECTS OF THE INVENTION

It is therefore a significant object of this invention to provide a new and improved compact, self-supporting fluidic smoking device or utensil which is capable of simple and easy disassemblage and assemblage for cleaning purposes.

Another significant object of this invention is the provision of an improved smoking device or utensil which can be used for extended periods of time without having to discard or replace one or more elements of the device or utensil.

A still further object of this invention is to provide a smoking device which is compact, sturdy and rugged in its construction and having a low center of gravity when in use.

Still another object of this invention is the provision of a through-opening in the base portion of the smoking device or utensil facilitating the easy cleaning of the same.

Additional objects of the invention are to provide a smoking device or utensil bearing the above objects in mind which is of simple construction, inexpensive to manufacture, pleasing in appearance, durable and unbreakable, light in weight, and efficient in operation.

BRIEF DESCRIPTION OF THE INVENTION

Briefly, in accordance with the invention, the self-supporting compact fluidic pipe of this invention comprises a substantially gibbous-like reservoir serving as a stable base member. The gibbous-like reservoir has an uppermost portion narrowing upwardly so as to form an open neck, and also contains a substantially flat bottom wall portion having an annular wall means extending upwardly therefrom and axially therewithin for defining a through-opening extending from the interior of the reservoir through the bottom wall portion. The opening has a diameter approximating at least one quarter the maximum diameter of the reservoir thereby providing easy access to the interior of the reservoir.

A removable sealing means for sealing the opening formed in the bottom of the reservoir facilitates the retention of a fluid material, such as, for example, water, within the reservoir. The sealing means is cup-shaped and has a bottom wall portion and an upstanding annular wall portion. In accordance with one embodiment of the present invention, the bottom wall portion lies in the same plane as the bottom wall portion of the reservoir so as to form a stable base member, while in accordance with another embodiment of the present invention, the bottom wall portion of the sealing means is disposed within a plane above the plane within which the bottom wall portion of the reservoir is disposed. This structure facilitates the manufacture of the smoking device in a considerably simpler and inexpensive manner due to the fact that manufacturing tolerances required in order to correlate the planes of the seal means and reservoir bottom wall do not have to be precisely met.

A first hollow elongated cylindrical tube having open upper and lower ends is also included therewith. The lower end of the first tube is integrally secured to the perimeter of the open neck of the uppermost portion of the reservoir and has means defining an aperture through a sidewall surface thereof near its lower end. A second hollow elongated cylindrical tube having open upper and lower ends is also used in combination therewith. The lower end is inserted through the aperture in the first tube and directed downwardly into the reservoir, the upper end of the second tube projecting outwardly from the first tube. A smoking bowl means is connected to the upper end of the second tube for retaining smoking tobacco and permitting smoke to pass into the second tube. The smoking bowl is detachably removable from the second tube, and the second tube is detachable from the first tube. The second tube and bowl also have outside diameters and lengths, respectively, less than the inside diameter and length of the first tube so as to permit the smoking bowl and second tube to be inserted and stored within the first tube of the device.

The smoke passing into the second tube is drawn through the fluid contained in the reservoir, and is further drawn from the reservoir into, through and out the upper end of the first tube.

The invention will be better understood and objects other than those set forth above will become apparent, when consideration is given to the following detailed description. Such description makes reference to the annexed drawings presenting preferred illustrative embodiments of the invention, and wherein.

DETAILED DESCRIPTION OF THE INVENTION

Figure 1:
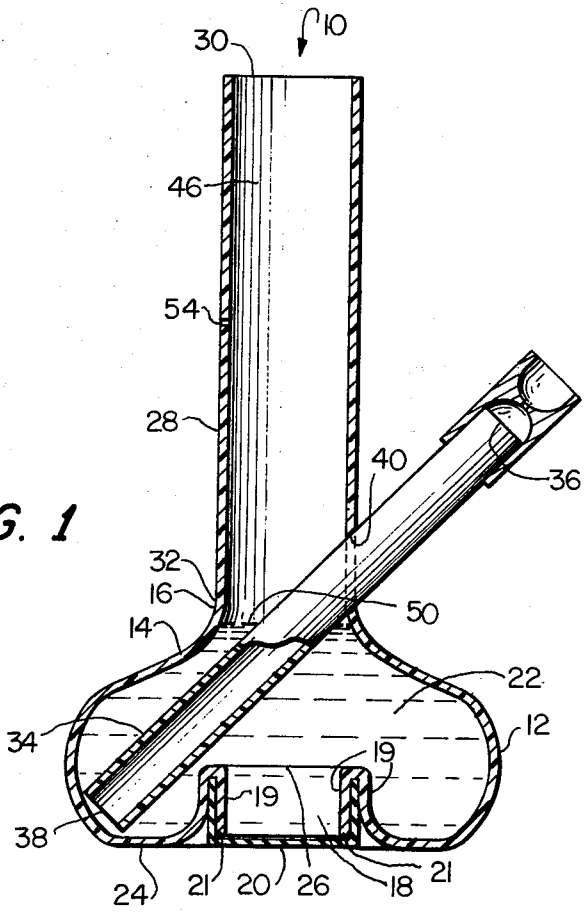
FIG. 1 is a cross-sectional view of a first embodiment of a self-supporting compact fluid pipe constructed in accordance with the present invention.

Referring more particularly to FIG. 1, the self-supporting compact fluidic pipe is illustrated generally by the numeral 10. The pipe comprises a substantially gibbous-like reservoir 12 serving as a stable base member. The reservoir 12 has an uppermost portion 14 narrowing upward and preferably incurvated, to define an open neck 15 and a substantially flat bottom portion 24. Annular wall means 19 extends upwardly from bottom wall 24, so as to project axially inwardly of the reservoir, for defining a through-opening or cavity 18 extending from the interior of the reservoir and through the bottom wall portion. The through-opening 18 is preferably centrally located and formed in the bottom of the reservoir 12, and is preferably defined by double convex walls 19, permitting a fluid 22 to be retained within the reservoir, once a removable cap means is screwed to the wall means 19 as will be described. The double convex walls 19 defining the through-opening 18 are formed by folding the lip 21 of the wall means 19 downwardly toward the bottom of the reservoir 12. The fluid may be any suitable filtering liquid such as water, wine or other liquid, as desired, with water being the preferred medium.

A removable sealing means or cap 20, is used for sealing the opening 26 in the bottom of the reservoir 12. The sealing means is dimensioned so as to seal the through-opening 18 by means of a capping action, and is a resilient material, such as, for example, rubber or other synthetic resin material, that is held in place due to the tight fit created by the walls defining the opening of the portion of lip 21 that extends towards the bottom of reservoir 12. The sealing means has a bottom portion and a wall portion. The bottom portion lies in the same plane with the bottom wall portion 24 of reservoir 12 so as to form a stable base member.

A first hollow elongated cylindrical tube 28 having an open top end 30 and a bottom end 32 is integrally secured to the perimeter of the open neck of the uppermost portion of the reservoir 12. Means defining a hole 40 through a sidewall surface of tube 28 is located near the bottom of tube 28.

A second hollow elongated cylindrical tube 34 having upper 36 and lower 38 open ends is inserted through hole 40 so as to be directed downwardly into the reservoir 12. The upper end 36 defines an opening. Tube 34 preferably has a smaller outside diameter than tube 28.

A smoking bowl means 42, which is preferably a reversible smoking bowl, is connected to the upper end 36 of the second tube 34 for retaining smoking tobacco and permitting smoke to pass into the second tube. The bowl is adapted to fit directly over open end 36 of tube 34 and smoking compartment 44 is designed to receive the smoking tobaccos.

In operation, the smoking tobacco is placed within compartment 44 of smoking bowl 42 and is lit by the user. Simultaneously, the user places his mouth over the open top end 30 of the first tube 28 and draws thereupon so as to create a partial vacuum in region 46 of tube 28. Smoke from the burning tobacco will be drawn through orifice 48 and will continue down through tube 34 and into liquid 22 by virtue of open end 38 of tube 28. The smoke then filters through the liquid 22 and continues upward into cylindrical tube 28, passing through the liquid level line 50 and continuing upward until it reaches the user's mouth.

Optionally, cylindrical tube 28 can have a small orifice 54 located at a point between the top and bottom open ends. Thus, during the initial drawing period, the user can maintain orifice 54 closed by means of his thumb or other appropriate means to prevent air from being drawn into the tube. Once a sufficient amount of smoke has been drawn into section 46 of member 28, the user may, at his option, permit air to be drawn in through orifice 54 and to mix with the smoke in member 28 so as to create a milder and mellower smoke mixture.

This new pipe arrangement is particularly efficient in that all of the smoke created by burning the tobacco in compartment 44 ultimately ends up in region 46 of tube 28 and is entirely, at the option of the user, drawn into the user's lungs. Accordingly, little or no smoke is wasted into the atmosphere as is the case with inefficient prior art pipes.

Figure 2:
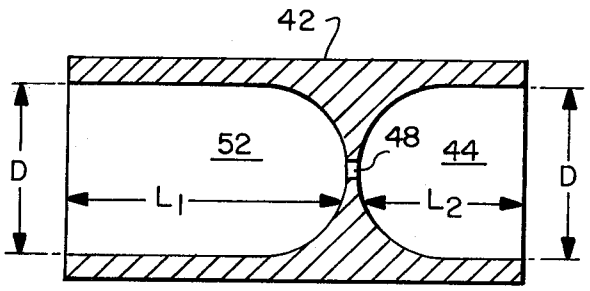
FIG. 2 shows a cross-sectional view of the reversible bowl for use in accordance with this invention.

Referring now to FIG. 2, the details of the preferred reversible bowl 42 which is disclosed in my U.S. Pat. Nos. 3,863,646 and 3,872,872, comprises a first smoking compartment 44 having an inside diameter and a second smoking compartment 52 also having the same inside diameter D. The two smoking compartments are connected by an orifice 48 having a diameter sufficient to permit smoke to pass therethrough while being capable of retaining the smoking tobaccos. Orifice 48 is large enough to permit ashes to fall therethrough, thus clearing an air passage which tends to mellow the smoke. The bowl which is preferably made of aluminum or other suitable material, is designed to fit snugly over the open end of cylindrical member 34, as illustrated in FIG. 1. It should be apparent that either compartment 44 or 52 can be made to slip over opening 36 of member 34, and that in either event, the appropriate remaining compartment becomes a smoking compartment. Thus, a single unitary device is capable of providing the user with two separate smoking bowls, each having the same diameter, but each having a different length ($L_1$ or $L_2$) such that a different amount of smoking tobacco may be utilized with the same smoking pipe.

Referring again to FIG. 1, it will be apparent that the smoking device can be easily disassembled for maintenance purposes, particularly the cleaning of the various functioning parts of the pipe. Thus, tube 34 can be easily removed from the portion immediately adjacent the end of tube 28. In addition, the resilient sealing means 20 can also be removed from the base of reservoir 14, thereby facilitating the easy and simple cleaning of the pipe after use. Because through-opening 18 has a diameter of at least about one quarter and preferably about one third the maximum diameter of the reservoir, easy access to the interior of the reservoir is achieved, particularly when cleaning utensils, such as, for example, brushes, are used for cleaning purposes.

For use in operation, cylindrical tube 34 is maintained at an acute angle with respect to the vertical orientation of cylindrical tube 28. This arrangement, however, is merely exemplary, and it will be understood that the functions and orientations of the cylindrical members or tubes need not be precisely as shown in the attached drawing. Thus, appropriate interchanges would be well within the skill of the art.

The cylindrical members or tubes 28 and 34 and reservoir 14 can be formed of a molded, hard, non-toxic transparent material such as glass or suitable transparent plastics so as to enable the user to determine readily the level of liquid and smoke contained therewithin.

During the storage or shipment, tube 34 as well as smoking bowl 42 are preferably detachably removable from the angular position illustrated in FIG. 1 and will easily fit within the larger tube 28.

Figure 3:
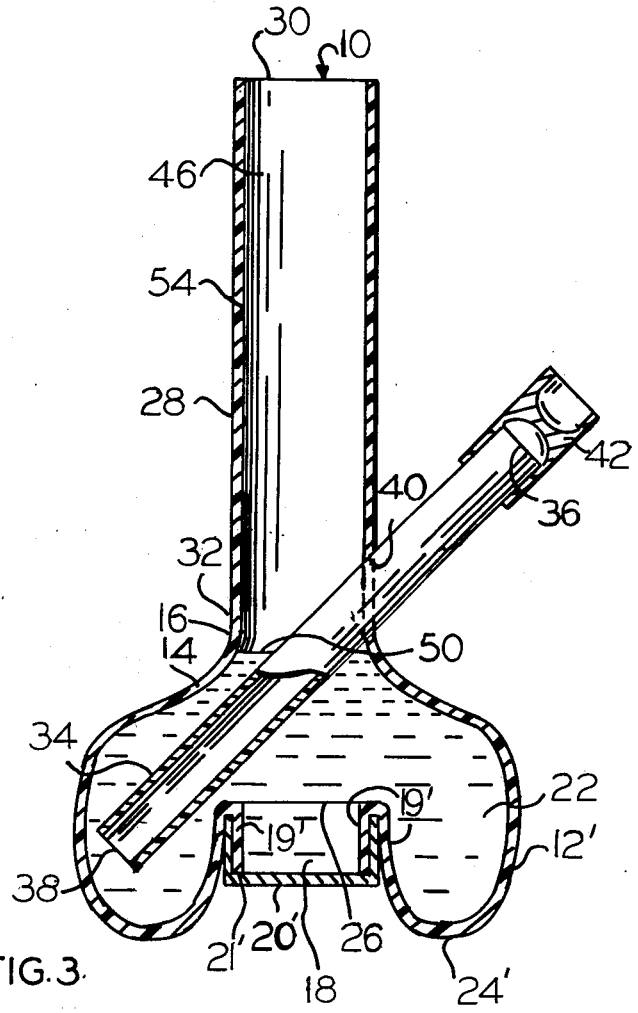
FIG. 3 is a view similar to that of FIG. 1, showing, however, a second embodiment of the present invention.

With reference now being made to FIG. 3, there is shown a second embodiment of the present invention wherein the only major difference between such an embodiment and the embodiment shown in FIG. 1 resides in the fact that the sealing means is disposed at an elevated level with respect to the bottom wall portion or base of the reservoir such that the sealing means within this second embodiment does not rest upon a support surface upon which the device is placed, for example, during use, and therefore, the sealing means in this embodiment does not serve as a support and stabilizing means as in the case of the first embodiment. The advantage, however, of disposing the sealing means at its elevated level in accordance with the second embodiment, and in a recessed mode with respect to the bottom portion of the reservoir, resides in the simplification of the manufacture of the device, and thereby a substantial reduction in costs thereof. In particular, as can well be appreciated from the first embodiment, the length of the annular wall means 19 must be precisely, or nearly so, within particular dimension tolerances such that when the sealing means 20 is disposed upon the device, the seal means will be disposed within the same plane as the bottom wall portion 24 of the reservoir. Otherwise, the device would in fact be quite unstable should, for example, the seal means be disposed within a plane lower than that of the bottom wall portion 24.

Consequently, in accordance with the second embodiment of the present invention, in order to dispose the sealing means within an elevated state as shown in FIG. 3, whereby the bottom wall portion of the seal means 20' is disposed in a plane above the plane of the bottom wall portion 24' of the reservoir, the depth of the sidewalls of the reservoir 12' may either be increased, or alternatively, the height of the annular double-wall structure 19' may be increased. As may be appreciated, modified elements or components of this second embodiment of the present invention, as compared to corresponding or similar components of the first embodiment, have been designated by the same reference characters for ease of understanding the invention, however, a prime mark (′), has been placed next to the modified element reference characters in order to distinguish the same from the corresponding elements of the first embodiment.

It should be apparent from the foregoing that a new and improved smoking device has been provided which is uniquely suitable for smoking rare and expensive tobaccos and which is portable, if desired, as well as being readily adaptable to cleaning and efficient maintenance. ACCORDINGLY,

What is claimed is:

1. A self-supporting compact pipe comprising:

a substantially gibbous-like reservoir serving as a stable base member, said gibbous-like reservoir having an uppermost portion to support said pipe in an independently upstanding position and narrowing upwardly so as to form an open neck, a substantially flat bottom wall portion having annular wall means extending inwardly of said reservoir for defining a through-opening extending from the interior of said reservoir and through said bottom wall portion;

said through-opening having a diameter approximating at least one quarter the maximum diameter of said reservoir so as to provide easy access to said interior of said reservoir;

removable sealing means for sealing said through-opening defined within said bottom wall portion of said reservoir so as to permit a fluid to be retained in, or drained from, said reservoir, a first hollow elongated cylindrical tube having upper and lower open ends, said lower open end being integrally secured to the perimeter of said open neck of said uppermost portion of said reservoir, and means defining an aperture through a sidewall surface of said first tube near the lower end of said first tube;

a second hollow elongated cylindrical tube having upper and lower open ends, said second tube being inserted through said first tube aperture such that said lower end of said second tube is directed downwardly into said reservoir and the upper end of said second tube projects outwardly of said first tube; and smoking bowl means detachably connected to the top end of said second tube for retaining smoking tobacco and permitting smoke to pass into said second tube;

said smoking bowl and said second tube being detachably removable from said first tube and having outside diameters and lengths, respectively, less than the inside diameter and length of said first tube so as to permit said smoking bowl and said second tube to be inserted and stored within said first tube;

wherein smoke passing into said second tube is drawn through said fluid contained in said reservoir, and further drawn from said reservoir into, through, and out the upper end of said first tube.

2. The self-supporting compact pipe of claim 1, wherein said fluid is water, and said fluid in said reservoir aids in stabilizing said fluidic pipe when standing upright.

3. The self-supporting compact fluidic pipe of claim 1, wherein said removable sealing means is a cap dimensioned to be insertable into said annular wall means of the base of said reservoir.

4. The self-supporting compact fluidic pipe of claim 3, wherein said cap is made from a resilient material.

5. The self-supporting compact fluidic pipe of claim 3, wherein said cap is cork or a synthetic resin.

6. The self-supporting compact fluidic pipe of claim 1, wherein said annular wall means of the base of said reservoir has convex walls for permitting easy insertion and removal of said sealing means.

7. The fluidic pipe of claim 1, wherein said second tube is inserted through said aperture in said first tube and into said reservoir, and its outwardly projecting end is disposed at an acute angle to the longitudinal axis of said first tube.

8. The fluidic pipe of claim 1, wherein said uppermost portion of said reservoir is incurvated.

9. The fluidic pipe of claim 1, wherein said annular wall means of said bottom wall portion of said gibbous-like reservoir is centrally located.

10. The fluidic pipe of claim 1, wherein said annular wall means of said bottom wall portion of said gibbous-like reservoir is double-walled.

11. The fluidic pipe of claim 10, wherein said double-walled annular wall means of said bottom wall portion of said gibbous-like reservoir further includes a lip projecting downwardly towards said bottom of said reservoir.

12. The fluidic pipe of claim 1, wherein said sealing means comprises:

a bottom wall portion; and an upstanding annular wall portion for engaging said annular wall means of said reservoir, said bottom wall portion of said sealing means being disposed within the same plane as said bottom wall portion of said reservoir.

13. The fluidic pipe of claim 1, wherein said sealing means comprises:

a bottom wall portion; and an upstanding annular wall portion for engaging said annular wall means of said reservoir, said bottom wall portion of said sealing means being disposed within a plane above the plane within which said bottom wall portion of said reservoir is disposed.

* * * * *